US012544624B2

(12) United States Patent
Jansson et al.

(10) Patent No.: US 12,544,624 B2
(45) Date of Patent: Feb. 10, 2026

(54) DETERMINING SPIN BASED ON CLUB PARAMETERS

(71) Applicant: Topgolf Sweden AB, Danderyd (SE)

(72) Inventors: Ludvig Jansson, Bromma (SE); Simon Johansson, Vasteras (SE); Kent Bertilsson, Skogas (SE)

(73) Assignee: Topgolf Sweden AB, Danderyd (SE)

( * ) Notice: Subject to any disclaimer, the term of this patent is extended or adjusted under 35 U.S.C. 154(b) by 0 days.

(21) Appl. No.: 18/665,112

(22) Filed: May 15, 2024

(65) Prior Publication Data

US 2024/0424343 A1 Dec. 26, 2024

(30) Foreign Application Priority Data

Jun. 20, 2023 (SE) ..... 2350755-1

(51) Int. Cl.
*A63B 24/00* (2006.01)
*A63B 71/06* (2006.01)
*A63B 69/36* (2006.01)

(52) U.S. Cl.
CPC ..... *A63B 24/0021* (2013.01); *A63B 71/0622* (2013.01); *A63B 2024/0034* (2013.01); *A63B 69/3694* (2013.01); *A63B 2220/05* (2013.01); *A63B 2220/89* (2013.01)

(58) Field of Classification Search
CPC ..... A63B 24/0021; A63B 71/0622; A63B 69/3694; A63B 2024/0034; A63B 2220/05; A63B 2220/89
See application file for complete search history.

(56) References Cited

U.S. PATENT DOCUMENTS

| | | | | |
|---|---|---|---|---|
| 8,409,024 | B2 * | 4/2013 | Marty | A63B 24/0003 356/28 |
| 9,415,277 | B2 * | 8/2016 | Kabeshita | A63B 45/00 |
| 10,213,645 | B1 * | 2/2019 | Wu | A63B 24/0003 |
| 10,456,651 | B2 * | 10/2019 | Choi | A63B 69/3658 |
| 11,844,981 | B2 * | 12/2023 | Korpach | A63F 13/537 |
| 12,002,222 | B2 * | 6/2024 | Oh | G06T 7/246 |
| 2016/0306035 | A1 * | 10/2016 | Johnson | G01S 13/878 |
| 2019/0147219 | A1 * | 5/2019 | Thornbrue | G06T 7/254 348/169 |
| 2019/0224552 | A1 * | 7/2019 | Kiraly | A63B 24/0021 |
| 2020/0398138 | A1 * | 12/2020 | Hendrix | A63F 13/812 |
| 2021/0069569 | A1 * | 3/2021 | Oh | G01S 13/88 |
| 2022/0339496 | A1 * | 10/2022 | Takuma | A63B 24/0021 |

(Continued)

*Primary Examiner* — Malina D. Blaise
(74) *Attorney, Agent, or Firm* — Michael A. Catania

(57) ABSTRACT

Methods and apparatus for determining spin of a golf ball in flight. At least a portion of an observed trajectory of the golf ball and one or more parameters associated with the trajectory are obtained. The parameters are selected from launch angle, ball speed, club speed and ball carry. Two or more spin candidates are obtained for the golf ball. Each spin candidate has an associated probability. A most probable used golf club for launching the golf ball into the observed trajectory is determined by matching the observed parameters with parameters for two or more different golf clubs. Ball spin probability data are obtained for the most probable used golf club. The spin of the golf ball is the most probable spin candidate, based on the ball spin probability data and the observed trajectory. The determined spin of the golf ball is displayed on a display device.

13 Claims, 2 Drawing Sheets

(56) References Cited

U.S. PATENT DOCUMENTS

| | | | | |
|---|---|---|---|---|
| 2022/0387873 | A1* | 12/2022 | Hall | A63B 24/0021 |
| 2023/0108761 | A1* | 4/2023 | Broadie | A63B 24/0003<br>473/407 |
| 2023/0271057 | A1* | 8/2023 | Bentley | A63B 71/0622<br>73/493 |
| 2023/0310964 | A1* | 10/2023 | Goodchild | G01S 17/88<br>473/199 |
| 2025/0213920 | A1* | 7/2025 | Thorup | A63B 69/3658 |

* cited by examiner

DETERMINING SPIN BASED ON CLUB PARAMETERS

CROSS REFERENCES TO RELATED APPLICATIONS

The Present application claims priority to Swedish Patent Application Number 2350755-1, filed on Jun. 20, 2023, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to determining a spin for a ball flying through the air, and more specifically to improving the accuracy of spin measurements made by a radar and/or camera.

Description of the Related Art

For various reasons, it is often desirable to know the spin of a ball, e.g., a golf ball, as it travels through the air. Often, a doppler radar is used to track the golf ball, and a tracking algorithm is applied to the measured data to derive the spin of the golf ball. The processing of the Doppler radar signal is focused on extracting the doppler frequency shift of the reflected radar signal from the moving golf ball. The frequency shift is proportional to the ball speed. Superimposed on the signal is a periodic signal that is related to the spin of the ball. The periodic signal is modeled to be a harmonic signal with fundamental frequency equal to the spin frequency. In some situations, the radar tracking of the ball can be complemented with camera-based tracking.

In some embodiments, the algorithms that are used to determine the spin of the ball are optimization algorithms, which use the measured data as input. However, sometimes these algorithms may produce inaccurate spin values: multiplicity error in the fundamental frequency, e.g., twice the actual spin, half the actual spin, etc. In addition, there might be aliasing effects due to poor sampling speed, leading to frequency folding effects. Further, there may be limitations that due to the hardware that is used to capture the velocity and spin data for the ball, for example, the signals from the doppler radar may be noisy, sometimes even having negative signal-to-noise ratios (SNRs). Setups which use cameras have limitations in terms of the resolution of their sensors, i.e., causing measurements of the velocity and/or direction of the ball at large distances to be more inaccurate. As a result, the algorithms may sometimes produce several spin candidates.

BRIEF SUMMARY OF THE INVENTION

In some aspects, the techniques described herein relate to a method for determining spin of a golf ball in flight. At least a portion of an observed trajectory of the golf ball and one or more parameters associated with the observed trajectory are obtained. The observed trajectory includes three-dimensional locations of the golf ball over time, as determined from individual observations of the golf ball by one or more sensors. Two or more spin candidates are obtained for the golf ball. Each spin candidate has an associated probability. A most probable used golf club for launching the golf ball into the observed trajectory is determined, based on probability data for one or more parameters for two or more different golf clubs. Ball spin probability data is obtained for the most probable used golf club. The spin of the golf ball is determined to be the spin candidate which is most probable, based on the ball spin probability data and the obtained portion of the observed trajectory, wherein the determining is based on a combination of measurement probability, club spin probability and physics probability. The determined spin of the golf ball is displayed on a display device.

In some embodiments, the one or more parameters can include one or more of: launch angle, ball speed, club speed, ball carry, or a combination thereof.

In some embodiments the obtained probabilities for the spin candidates can be adjusted based on predetermined parameters of the most probable used golf club and/or based on a similarity between the portion of the observed trajectory and a corresponding portion of a simulated trajectory for the obtained two or more spin candidates, and the spin of the golf ball can be determined to be the spin candidate having the highest adjusted probability.

In some embodiments determining a most probable used golf club for each golf club in the plurality of different golf clubs can include comparing the obtained one or more parameters to the probability data for the one or more parameters for the two or more different golf clubs.

In some embodiments the probability data can be either a Gaussian probability distribution or a measured histogram probability distribution for the two or more different golf clubs.

In some embodiments determining a most probable used golf club includes providing the obtained one or more parameters as input to a previously constructed network of nodes with trained weights, which has been trained for the two or more different golf clubs using one or more obtained parameters from earlier golf ball flights.

In some embodiments the ball spin probability data can be defined as a mean spin value and a standard deviation of spin values for the most probable used golf club.

In some embodiments the similarity between the portion of the observed trajectory and a corresponding portion of a simulated trajectory for a spin candidate can be determined by simulating a trajectory of the golf ball having the spin of the spin candidate, where the simulation uses a physics model and one or more of the obtained parameters, selecting a plurality of instances in time, and for each selected instance, determining a difference between the observed trajectory and the simulated trajectory, respectively, and combining the differences to obtain a similarity value to be used when adjusting the probability for the spin candidate.

In some embodiments the difference is a difference in one or more of: acceleration, velocity, and/or position of the golf ball, and combining the differences includes one or more of: averaging the differences, summing the differences, and/or comparing the difference to find the smallest difference.

In some embodiments the differences can be modified prior to combining the differences by adding a weight factor to each difference and/or raising one or more of the differences to a predetermined power.

In some embodiments the method is performed at a golf practice range or golf course.

In some embodiments the one or more sensors include a radar, a camera, or both. Other technical features may be readily apparent to one skilled in the art from the following figures, descriptions, and claims.

In some aspects, the techniques described herein relate to a system and a computer software program product, respectively, for determining spin of a golf ball in flight.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
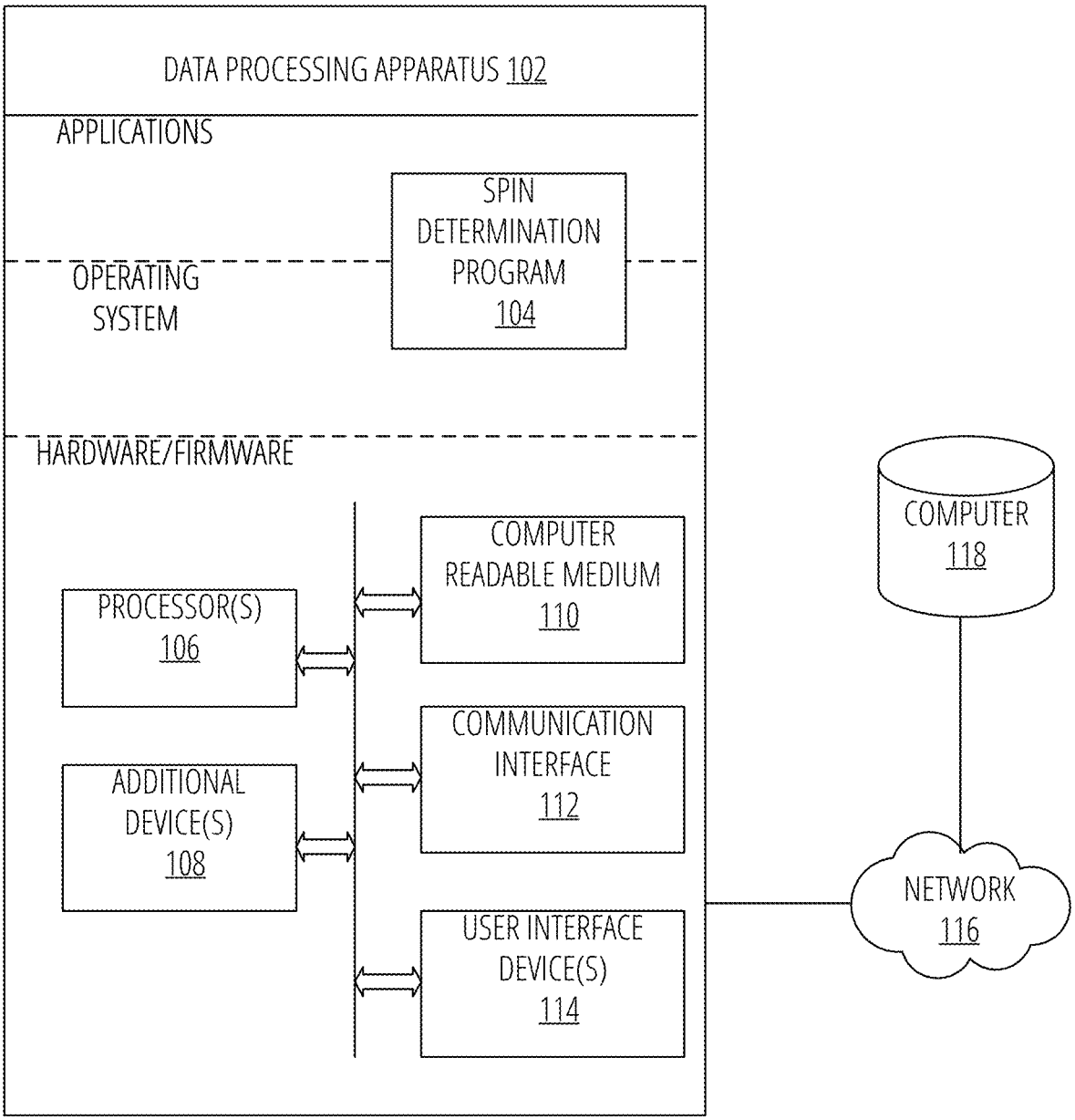
FIG. 1 is a block diagram showing a data processing apparatus that can be used to perform the methods of the invention, in accordance with some embodiments.

As shown in FIG. 1.

The various embodiments of the invention pertain to techniques for determining the spin of a golf ball, in flight. In particular, the various embodiments provide techniques for discerning which spin candidate among a several possible spin candidates is the most likely one, by using data for different golf clubs to first see how well an observed trajectory for the ball matches simulated trajectories for different golf clubs, to determine a most probable used golf club that was used to launch the golf ball. Once the most probable used golf club has been determined, previously collected spin data for the most probable used golf club are used to determine which one among the different spin candidates produced by a ball tracking algorithm is the most likely one. The spin candidate having the highest overall likelihood is selected as the spin for the golf ball. The most probable used golf club denotes the golf club that a player most likely used when launching the golf ball under observation.

Various embodiments of the subject matter described in this specification can be implemented to realize one or more of the following advantages. A correct spin candidate can be selected among two or more spin candidates, which can ensure that correct information is conveyed to a player, for example, for training purposes, or to an audience watching a golf tournament on TV. This can be of significant benefit when several or multiple spin candidates are initially produced. Correspondingly, having a supplemental mechanism for determining the spin also reduces the precision requirements of the radars and/or cameras that are used to obtain the ball trajectory, which may decrease the cost and make such systems more widely available. Various embodiments will now be described in further detail by way of example and with reference to the drawings.

Distinct types of computers can be used in the system. The essential elements of a computer are a processor for performing instructions and one or more memory devices for storing instructions and data. As used herein, a "computer" can include a server computer, a client computer, a personal computer, embedded programmable circuitry, or a special purpose logic circuitry. FIG. 1 is a schematic diagram of a data processing system including a data processing apparatus 102, which represents an embodiment of the computer 102. The data processing apparatus 102 can be connected with one or more computers 118 through a network 116.

The data processing apparatus 102 can include various software modules, which can be distributed between an applications layer and an operating system. These can include executable and/or interpretable software programs or libraries, including spin determination program 104, for example, for determining the spin of a golf ball. The number of software modules used can vary from one embodiment to another. Also, in some cases, the spin determination program 104 can be implemented in embedded firmware, and in other cases, the spin determination program 104 can be implemented as software modules that are distributed on one or more data processing apparatus connected by one or more computer networks or other suitable communication networks.

The data processing apparatus 102 can include hardware or firmware devices including one or more processor(s) 106, one or more additional device(s) 108, a non-transitory computer-readable medium 110, a communication interface 112, and one or more user interface device(s) 114. The processor 106 is capable of processing instructions for execution within the data processing apparatus 102, such as instructions (e.g., of the spin determination program 104) stored on the non-transitory computer readable medium 110, which can include a storage device such as one of the additional device(s) 108.

In some embodiments, the processor 106 is a single or multicore processor, or two or more central processing units (CPUs). The data processing apparatus 102 uses its communication interface 112 to communicate with one or more computers 118, for example, over the network 116. Thus, in various embodiments, the processes described can be run in parallel, concurrently, or serially, on a single or multi-core computing machine, and/or on a computer cluster/cloud, etc.

Examples of user interface device(s) 114 include a display, a touchscreen display, a speaker, a microphone, a tactile feedback device, a keyboard, a mouse, and a headset or heads-up display of a virtual reality or augmented reality environment system. Moreover, the user interface device(s) need not be local user interface device(s) 114 but can be remote from the data processing apparatus 102, e.g., user interface device(s) accessible via one or more networks 116. For example, the user interface device(s) 114 can be a smartphone or a tablet computer of the user, e.g., for an augmented reality embodiment. The data processing apparatus 102 can store instructions that implement operations as described in this document, for example, on the non-transitory computer readable medium 110, which can include one or more additional device(s) 108, for example, one or more of a floppy disk device, a hard disk device, an optical disk device, a tape device, and a solid-state memory device, e.g., a random access memory (RAM) drive.

Moreover, the instructions that implement the operations described in this document can be downloaded to the non-transitory computer readable medium 110 over the network 116 from one or more computers 118 (e.g., from the cloud). In some embodiments, the data processing apparatus 102 is a smartphone or a tablet computer. In some embodiments, the RAM drive is a volatile memory device to which the instructions are downloaded each time the computer is turned on.

Figure 2:
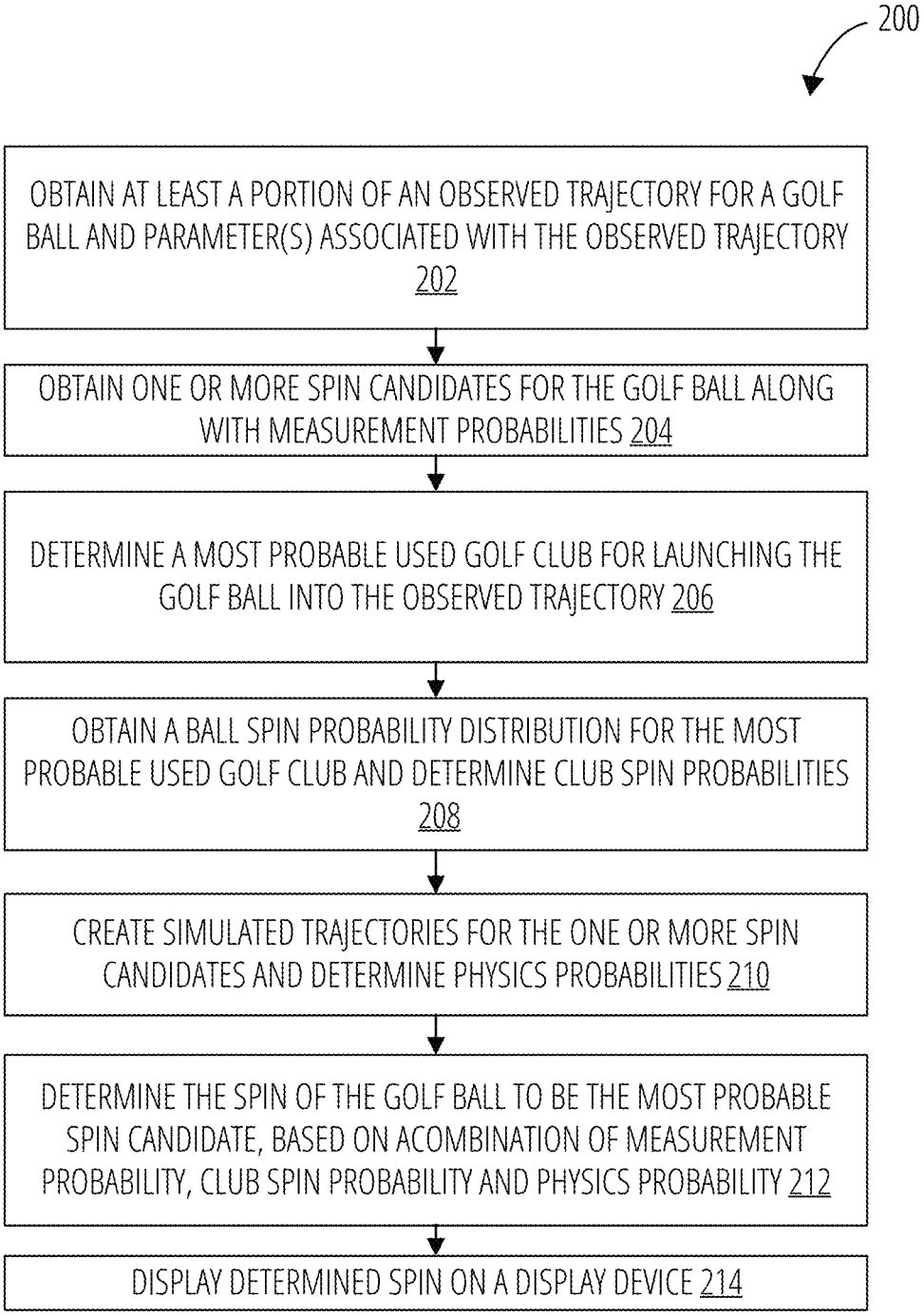
FIG. 2 is a flowchart of a method for determining spin of a ball in flight, in accordance with some embodiments.

FIG. 2 is a flowchart of a method 200 for determining the spin of a golf ball in flight, in accordance with some embodiments. The method is a computer-implemented method, e.g., performed by the data processing apparatus 102 of FIG. 1, or the like. As can be seen in FIG. 2, a portion of an observed trajectory for a golf ball and parameter(s) associated with the observed trajectory are obtained, 202, such as by being received from the ball tracking algorithm. The observed trajectory typically includes a list of values for various parameters observed by the radar and/or camera devices (or derived from the observations) for a sequence of points in time. Generally, the time window during which the points are collected encompass the entire flight of the golf ball, but there may be implementations where the data is collected during a time window that only encompasses a portion of the time during which the ball is in flight. The number of points may vary, but in the most common implementations, anywhere between 10 and 120 points are recorded each second. This number may, however, be larger or smaller, depending on the particular capabilities of the equipment used. Some examples of parameters include position, velocity, and acceleration of the golf ball for different points in time. Parameters such as speed and acceleration can either be measured directly or be calculated as first or second derivatives, respectively, of position and/or velocity measurements of the golf ball. From these parameters, yet further parameters can be derived, such as the ball speed (i.e., the speed of the golf ball's center of gravity immediately after separation from the club face), the launch angle (i.e., the vertical angle the golf ball takes off at relative to the horizon and measured immediately after separation from the club face), the carry (i.e., the straight-line distance between where the golf ball was launched from and where it crosses a point that has the same elevation, sometimes also referred to as "flat carry"), and so on. It should be noted that some of these parameters (e.g., ball speed) may in fact be difficult to obtain at the very beginning of a shot (e.g., due to the camera having poor or no visibility of the starting point), and in those cases, the initial values for some of the parameters at the starting point of the trajectory may instead be derived from measured or calculated parameter values during a latter part of the observed trajectory.

Next, two or more spin candidates for the golf ball are obtained, 204. The spin candidates are typically obtained as an output from some signal processing software and/or hardware in the radar device used for tracking the ball. This can be done in many ways. In some embodiments, a set of "windows" is considered, each window covering a subset of the observed trajectory and for each window, the doppler effect is used to obtain a possible spin value. As was noted above, due to limitations in signal processing, noise, and/or aliasing, in most cases several spin candidates are provided. In some embodiments, each spin candidate also has an associated probability, referred to herein as a measurement probability, which can be calculated, for example, as the relative frequency of the different spin values.

The method then determines a most probable used golf club for launching the golf ball into the observed trajectory, 206. This determination can involve comparing one or more observed parameter values for the trajectory of the golf ball with previously observed and verified data for each golf club in a set of golf clubs. Some examples of parameters that can be used in this comparison include launch angle, ball speed, club head speed, and/or ball carry, although this list should not be considered exhaustive and there may be other parameters that are suitable for determining what golf club was used to launch the golf ball, such as the vertical landing angle and speed, trajectory apex and/or the general shape of the trajectory.

The previously collected data for each golf club can include, for example, histograms for each of these parameters for shots made by each golf club. The observed value for the golf ball can then be compared on a parameter-by-parameter basis with corresponding parameter values for the different golf clubs. In some embodiments, the comparisons are made directly with the collected histograms. In some embodiments, the histograms can have undergone some prior processing, for example, calculating a mean and a standard deviation for each parameter and creating a Gaussian probability distribution approximation of the histogram data, and the observed parameter values can be compared with these probability distributions.

In some embodiments, the individual probabilities for each parameter among the different parameters included in the determination of the most probable used golf club are combined into a single probability, for example, by calculating the product between the individual probabilities for each parameter. It should be noted that the accuracy of such a calculation generally improves when the parameters are independent of one another. For example, combining only a launch angle parameter and a ball speed parameter may yield a better result than what would occur if further parameters such as club head speed and carry were also added, as these further parameters are related to the launch angle and ball speed. This methodology can be thought of as a version of a Naive Bayes approach. The result of these comparisons is that a most probable used golf club is determined.

It should be noted that the differences in parameter values may be fairly small between certain golf clubs. For example, a 3-iron and a 4-iron club, respectively, may exhibit similar histograms (and thereby also similar mean spin values and standard deviations). For those reasons, it may be suitable in some embodiments to reduce the set of available golf clubs to which the observed parameters are compared, for example, such that the set of available golf clubs only includes a 3-iron and a 5-iron but not a 4-iron, or such that the set of available golf clubs only includes a 50-degree wedge, but not a 52- or 54-degree wedge, etc. In essence, the general idea is to avoid having a set of golf clubs that have parameter values too close to one another, so limiting the available clubs to every second or third club in a set, for example, allows for more distinct differences and a more robust and reliable club determination. In some embodiments, the set of available clubs may vary based on the hole that is played. For example, it may not be reasonable to consider a pitching wedge as one of the candidates for a shot at the beginning of a par 5 hole, or to consider a driver as one of the candidates at the start of a par 3 hole. Thus, there are many ways in which the selection of available clubs can be reduced.

Furthermore, for a given club, the parameter values may vary depending on the player. Therefore, some embodiments include several sets of parameter values for a golf club, such as one set of parameter values for professional players and another set of parameter values for amateur players. In some embodiments, various parameter value sets can be based on location, for example, a certain golf club may produce different spin at high altitude versus sea level. Thus, many versions for determining a most probable used golf club can be envisioned.

Next, when a most probable used golf club has been determined, ball spin probability data is obtained for the most probable used golf club, 208. That is, similar to what was described above for the various parameters, there is also information available for each golf club about a range of spin values that are the most probable for the golf club. Typically, this includes a mean and a standard deviation for the most probable used golf club. Thus, each spin candidate at this point can be compared to that mean spin value and standard deviation and be assigned a "club spin probability" that indicates how likely the most probable used golf club generated that spin candidate.

Next, a simulated trajectory is determined for each spin candidate, using a physics model, 210. There are many physics models that can be used for calculating spin. In general, they are based on the idea that it is well-known that for a rotationally symmetric ball in flight, three main forces act on the ball: gravity, air resistance (also referred to as "drag"), and the "lift" of the ball due to the Magnus Effect. These forces can be represented by vectors, and together form the total acceleration of the ball. The following is an example of one physics model that can be used for purposes of generating a simulated trajectory:

$$\vec{a}_M = |\vec{a}_M|\hat{a}_M \propto \vec{\Omega} \times \vec{v}_{rel}$$

Where $$\vec{v}_{rel} = \vec{v}_{ball} - \vec{v}_{wind}$$

$$\left|\vec{\Omega} \times \vec{v}_{rel}\right| = |\vec{\Omega}||\vec{v}_{rel}|\sin(\Phi)$$

wherein $\Phi$ is the angle between $\vec{\Omega}$ and $\vec{v}_{rel}$

This means that $$\vec{\Omega} \times \vec{v}_{rel} = |\vec{\Omega}||\vec{v}_{rel}| \cdot \hat{\Omega} \times \hat{v}_{rel}$$

$$\left|\hat{\Omega} \times \hat{v}_{rel}\right| = \sin(\Phi) \neq 1$$

And from this follows that:

$$\hat{a}_M \propto \hat{\Omega} \times \hat{v}_{rel},$$

$$\hat{a}_M = \frac{\hat{\Omega} \times \hat{v}_{rel}}{\left|\hat{\Omega} \times \hat{v}_{rel}\right|}.$$

In the above equations, all terms with a "hat" are unit vectors and all terms with arrows are vectors (i.e., a magnitude and a unit vector). Furthermore: a_M_arrow is the acceleration due to lift (the so-called Magnus effect); v_rel is the relative velocity vector (i.e., the difference between the ball velocity vector and the wind velocity vector); omega is the spin vector. The absolute value is the magnitude of the corresponding vector. The cross product of two vectors is the plane spanned by the two vectors, and having a direction that is normal to the plane. Since the spin vector in general is neither orthogonal nor parallel to the relative velocity vector, it is necessary to consider sin(phi). Thus, in order to obtain the unit acceleration vector due to lift, a_M_hat, it is necessary to normalize the cross product of omega_hat and v_rel_hat.

Using this physics model, the portion of the observed trajectory that was obtained in operation 202 is compared with the corresponding portion of the simulated trajectory to determine a degree of similarity between the two trajectories, i.e., how well the real-world observations match the theoretical expectations. An error between the measured and the simulated trajectory is determined for each spin candidate, and the error is converted into a "physics probability" for each spin candidate. Typically, a smaller error indicates a better match between the simulated trajectory and the observed trajectory, and thus results in a higher physics probability for the spin candidate in question. Depending on the particular situation at hand, the error measure can use deviations in, for example, position, speed and/or acceleration between corresponding points in time between the simulated trajectory and the observed trajectory for each spin candidate. Some embodiments use a least square method aggregated over a number of points along the selected portion of the trajectories to generate an overall error measure. The inverse of this error measure is then used as a probability value for the spin candidate. However, these are merely some examples, and there are many other types of error calculation methods that may be useful in this context. Different weight factors and different exponents can also be used, and further factors (e.g., wind) can be considered to achieve a robust error measure that describes how well the portions of the observed and simulated trajectories match. In some embodiments, the relevant weight factors, and parameters to use when determining the error measure can be selected through an optimization process.

Next, the spin of the golf ball is determined to be the spin candidate that is most probable, based on the combination of measurement probability, club spin probability, and physics probability, 212. This can be done, for example, by multiplying the individual probabilities with each other for each spin candidate, and then selecting the spin of the golf ball to be the spin candidate with the highest combined probability. Finally, the spin of the golf ball is displayed on a display device, 214. The display of the determined spin can be done for entertainment (e.g., for an audience watching a golf tournament) or for training (e.g., to facilitate improvement of a person's golf game).

In some embodiments, an optimization process can be used with respect to determining what portions of a trajectory to use when determining the error measure between the observed trajectory and the simulated trajectory. For example, a section of the trajectory that is closer to the end may suffer from a weaker reflected signal from the radar tracking device, or more optical distortions as the distance from the camera increases. This causes an increase in the noise that is present in the measurement values from these respective sensors. In particular acceleration measurements are noise sensitive. Thus, if acceleration is used as one of the parameters in the error measurement calculation, a portion of the trajectory that is closer to the origin can be used in some embodiments. However, if velocity or position are parameters that are used in calculating the error, then a portion of the trajectory towards the middle or far end can be used in some embodiments. Thus, various types of optimization processes can be used to determine the most ideal portion of the trajectory for error measurement calculation purposes.

The embodiments of the present invention described herein also relate to a computer software function for determining a spin of a ball, such as a golf ball, according to what has been described above. Such a computer software function is then arranged to, when executing, perform the above-described obtaining, determining, and displaying operations, which are also recited in the claims. The computer software function is arranged to execute on physical or virtual hardware of the computer and/or the data processing apparatus 102, as described above.

Embodiments of the subject matter and the functional operations described in this specification can be implemented in digital electronic circuitry, or computer software, firmware, or hardware, including the structures disclosed in this specification and their structural equivalents, or in combinations of one or more of them. Embodiments of the subject matter described in this specification can be implemented using one or more modules of computer program instructions encoded on a non-transitory computer-readable medium for execution by, or to control the operation of, data processing apparatus. The computer-readable medium can be a manufactured product, such as hard drive in a computer system or an optical disc sold through retail channels, or an embedded system. The computer-readable medium can be acquired separately and later encoded with the one or more modules of computer program instructions, such as by delivery of the one or more modules of computer program instructions over a wired or wireless network. The computer-readable medium can be a machine-readable storage device, a machine-readable storage substrate, a memory device, or a combination of one or more of them.

The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, a runtime environment, or a combination of one or more of them. In addition, the apparatus can employ various computing model infrastructures, such as web services, distributed computing, and grid computing infrastructures.

A computer program (also known as a program, software, software application, script, or code) can be written in any suitable form of programming language, including compiled or interpreted languages, declarative or procedural languages, and it can be deployed in any suitable form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and one or more processors of any suitable digital computer. Generally, a processor will receive instructions and data from a read-only memory (ROM) or a random-access memory (RAM), or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media, and memory devices, including by way of example semiconductor memory devices, e.g., EPROM (Erasable Programmable Read-Only Memory), EEPROM (Electrically Erasable Programmable Read-Only Memory), and flash memory devices; magnetic disks, e.g., internal hard disks or removable disks; magneto-optical disks; CD-ROM and DVDROM disks; network attached storage; and various forms of cloud storage. The processor and the memory can be supplemented by, or incorporated in, special purpose logic circuitry.

To provide for interaction with a user, embodiments of the subject matter described in this specification can be implemented on a computer having a display device, e.g., LCD (liquid crystal display), OLED (organic light emitting diode), or other monitor, for displaying information to the user and a keyboard and a pointing device, e.g., a mouse or a trackball, by which the user can provide input to the computer. Other kinds of devices can be used to provide for interaction with a user as well; for example, feedback provided to the user can be sensory feedback, e.g., visual feedback, auditory feedback, or tactile feedback; and input from the user can be received in various forms, including acoustic, speech, or tactile input.

The computing system can include clients and servers. A client and server are generally remote from each other and interact through a communication network. The relationship of client and server arises by virtue of computer programs running on the respective computers and having a client-server relationship to each other. Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an embodiment of the subject matter described in this specification, or any suitable combination of one or more such back-end, middleware, or front-end components. The components of the system can be interconnected by any suitable form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many implementation details, these should not be construed as limitations on the scope of the invention or of what may be claimed, but as descriptions of features specific to embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination. Thus, unless explicitly stated otherwise, or unless the knowledge of one of ordinary skill in the art clearly indicates otherwise, any of the features of the embodiment described above can be combined with any of the other features of the embodiment described above.

Similarly, while operations are depicted in the drawings in a particular order, this should not be understood as requiring that such operations be performed in the order shown or in sequential order, or that all illustrated operations be performed, to achieve desirable results. In certain circumstances, multitasking and/or parallel processing may be advantageous. Moreover, the separation of various system components in the embodiments described above should not be understood as requiring such separation in all embodiments. The described program components and systems can be integrated into a single software product or packaged into multiple software products.

Thus, embodiments of the invention have been described. Other embodiments are within the scope of the following claims. For example, in some embodiments, various types of machine learning (ML) techniques can be applied to identify the most probable used golf club and the most likely spin candidate. Typically, such an approach would entail providing the obtained one or more input parameters to a previously constructed network of nodes with trained weights, which has been trained for a set of golf clubs using obtained parameters from earlier golf ball flights.

When selecting input parameters for the ML model, it is important to select parameters that are not dependent on estimated spin. For example, if "flat carry" were selected as an input parameter and the entire trajectory is not visible, the flat carry would need to be estimated, and to make such an estimate, an estimated spin would be needed. Thus "flat carry" is an example of an input parameter that may not be very good when using an ML model. If flat carry were to be selected as an input parameter to the ML model nevertheless, it would be advisable to have a further input parameter that indicates what portion of the trajectory has been observed, such that the ML model can also consider whether the flat carry input parameter actually is reliable (i.e., the entire trajectory has been visible), or is a less reliable estimation due to only a portion of the trajectory having been visible.

Two examples of ML techniques that may be suitable in this context are Neural Networks and Random Forest, respectively. It should, however, be realized that these are merely examples and that there may also be additional ML techniques that work well in this context. The Neural Network can use a feed forward/multilayer perceptron architecture, in which the input layer has one node per input parameter. The number of hidden layers and the number of nodes in each layer can be selected by what produces the best results. The output layer can be of the SoftMax variety with one node per class (i.e., golf club). The activation function can be of the ReLU (Rectified Linear Unit) type, possibly with a regularization similar to dropout. This method produces an output probability (e.g., "there is a 25% likelihood that the club is a 5-iron"), rather than simply stating "a 5-iron", which is advantageous in the methods described above. The Random Forest model, on the other hand, is an ensemble of decision trees whereby the final/leaf node will be the majority class for classification problems. The Random Forest model can include parameters such as the depth of each decision tree, how the data should be distributed, cost functions, etc.

Typically, the ML models are trained using training data that is collected and verified, in some embodiments for different segments of players (LPGA (Ladies Professional Golf Association), PGA (Professional Golfer's Association), amateur, etc.), and in some embodiments purely on an individual player basis. In many situations, the training data may be a bit skewed, i.e., there will be more data for a particular type of player/golf club. This may introduce a bias in the algorithm that is used. For example, if the most common shot is an "amateur 5-iron shot", then the algorithm will tend to classify shots as being made by a 5-iron club. This can be addressed in multiple ways, for example, by duplicating shots, assigning different weights to classes (golf clubs), i.e., allowing an error for a less common golf club in the data set have a larger effect on the cost function compared to a more common golf club when training the model, to randomly sample the data when training the model, etc.

Lastly, it should be noted that while the description above has been made in the context of golf balls and golf clubs, it should be realized that the same general principles can be applied in other situations where it is advantageous to know the spin of a ball or other flying projectile, where there is a number of clubs or other launch mechanisms having a characteristics that affect the spin of the ball or projectile in particular ways. Thus, many variations to the above examples lie well within the scope of the attached claims and within the capabilities of a person having ordinary skill in the art.

Thirkettle et al., U.S. Pat. No. 7,056,221 for a Ball Collection Arrangement, is hereby incorporated by reference in its entirety.

Golliffe et al., U.S. Pat. No. 7,059,974 for Golf Balls With Impact Resistant Identification Device, is hereby incorporated by reference in its entirety.

Thirkettle et al., U.S. Pat. No. 7,160,196 for an Identification Device, is hereby incorporated by reference in its entirety.

Thirkettle et al., U.S. Pat. No. 7,337,965 for a Ball Identifying Device, is hereby incorporated by reference in its entirety.

Savarese et al., U.S. Pat. No. 7,691,009 for Apparatus And Methods Relating To Findable Balls, is hereby incorporated by reference in its entirety.

Savarese et al., U.S. Pat. No. 7,766,766 for Methods And Apparatus Relating To Findable Balls, is hereby incorporated by reference in its entirety.

Cheng, U.S. Pat. No. 7,806,777 for Automatically Adapting Virtual Equipment Model, is hereby incorporated by reference in its entirety.

Cheng, U.S. Pat. No. 7,847,808 for Photographic Mapping In A Simulation, is hereby incorporated by reference in its entirety.

Savarese et al., U.S. Pat. No. 8,002,645 for Apparatus, Methods And Systems Relating To Findable Balls, is hereby incorporated by reference in its entirety.

Cheng, U.S. Pat. No. 8,029,359 for Providing Offers To Computer Game Players, is hereby incorporated by reference in its entirety.

Forsgren, U.S. Pat. No. 8,077,917 for Systems And Methods For Enhancing Images in A Video Recording of A Sports Event, is hereby incorporated by reference in its entirety.

Caster et al., U.S. Pat. No. 9,132,326 for a System For Providing Loaner Clubs To Novice Golfers, is hereby incorporated by reference in its entirety.

Forsgren, U.S. patent Ser. No. 10/596,416 for a System And Method For Three Dimensional Object Tracking Using Combination of Radar And Image Data, is hereby incorporated by reference in its entirety.

Semsak et al., U.S. patent Ser. No. 10/799,770 for a RFID Golf Ball Testing Apparatus, is hereby incorporated by reference in its entirety.

Johansson et al., U.S. patent Ser. No. 10/898,757 for Three Dimensional Object Tracking Using Combination of Radar Speed Data And Two Dimensional Image Data, is hereby incorporated by reference in its entirety.

Forsgren et al., U.S. patent Ser. No. 11/335,013 for Motion Based Pre-Processing Of Two-Dimensional Image Data Prior To Three-Dimensional Object Tracking With Virtual Time Synchronization, is hereby incorporated by reference in its entirety.

Forsgren, U.S. Patent Publication Number 20200391077 for a System And Method For Three Dimensional Object Tracking Using Combination of Radar And Image Data, is hereby incorporated by reference in its entirety.

Johansson et al., U.S. patent Ser. No. 11/504,582 for Three Dimensional Object Tracking Using Combination of Radar Speed Data And Two Dimensional Image Data, is hereby incorporated by reference in its entirety.

Eriksson, U.S. patent Ser. No. 11/513,208 for Method For Determining Spin Of A Projectile, is hereby incorporated by reference in its entirety.

Hugmark et al., U.S. patent Ser. No. 11/644,562 for Trajectory Extrapolation And Origin Determination For Objects Tracked Flight, is hereby incorporated by reference in its entirety.

Forsgren, U.S. patent Ser. No. 11/697,046 for a System And Method For Three Dimensional Object Tracking Using Combination of Radar And Image Data, is hereby incorporated by reference in its entirety.

Hugmark et al., U.S. patent Ser. No. 11/771,957 for Trajectory Extrapolation And Origin Determination For Objects Tracked Flight, is hereby incorporated by reference in its entirety.

Levin, U.S. patent Ser. No. 11/409,411 for a Single Finger User Interface Camera Control, is hereby incorporated by reference in its entirety.

Johansson et al., U.S. patent Ser. No. 11/504,582 for Three Dimensional Object Tracking Using Combination of Radar Speed Data And Two Dimensional Image Data, is hereby incorporated by reference in its entirety.

Stroud, U.S. patent Ser. No. 11/779,809, for a Method And System Utilizing A Golf Shot API Proxy, is hereby incorporated by reference in its entirety.

Burdette, U.S. patent application Ser. No. 18/202,178, filed on May 25, 2023, for a Golf Ball Identification Apparatus And System, is hereby incorporated by reference in its entirety.

Burdette et al., U.S. Patent Publication Number 20220203178, for a Golf Ball Dispenser With Embedded Display Device, Separate Front waterfall And/Or Blower Assembly, is hereby incorporated by reference in its entirety.

Burdette et al., U.S. Patent Publication Number 20230338801, for a Galton Configuration In Golf Ball Receiving Apparatus And Systems, is hereby incorporated by reference in its entirety.

Ekstrom et al., U.S. patent Ser. No. 11/786,783 for Identifying A Location For A Striker Of An Object, is hereby incorporated by reference in its entirety.

Eriksson et al., U.S. patent Ser. No. 11/815,618 for Doppler Radar Coexistence, is hereby incorporated by reference in its entirety.

Wase, U.S. patent Ser. No. 11/934,085 for a Camera Mounting Post, is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A computer-implemented method (200) for determining spin of a golf ball in flight, comprising:

obtaining, at a spin determination program of a data processing apparatus, at least a portion of an observed trajectory of the golf ball and one or more parameters associated with the observed trajectory, wherein the one or more parameters include one or more of launch angle, ball speed, club speed, ball carry, or a combination thereof, the observed trajectory comprising three-dimensional locations of the golf ball over time, as determined from observations of the golf ball by one or more camera based tracking sensors;

obtaining, at a spin determination program of a data processing apparatus, two or more spin candidates for the golf ball, each spin candidate having an associated measurement probability indicating relative frequency of different spin values;

determining, at a spin determination program of a data processing apparatus, a most probable used golf club for launching the golf ball into the observed trajectory, based on probability data for one or more parameters for two or more different golf clubs;

obtaining, at a spin determination program of a data processing apparatus, ball spin probability data for the most probable used golf club;

determining, at a spin determination program of a data processing apparatus, the spin of the golf ball to be the spin candidate which is most probable, based on the ball spin probability data and the obtained portion of the observed trajectory; wherein the determining is based on a combination of measurement probability, club spin probability and physics probability, wherein the club spin probability indicates how likely the most probable used golf club generated the spin candidate, and the physics probability refers to probability converted from an error between the observed trajectory and a simulated trajectory, and displaying the determined spin of the golf ball on a display of a user interface device.

2. The method of claim 1, further comprising:

adjusting the obtained probabilities for the spin candidates based on predetermined parameters of the most probable used golf club and/or based on a similarity between the portion of the observed trajectory and a corresponding portion of the simulated trajectory for the obtained two or more spin candidates; and determining the spin of the golf ball to be the spin candidate having the highest adjusted probability.

3. The method of claim 2, wherein determining the most probable used golf club comprises:

for each golf club in the plurality of different golf clubs, comparing the obtained one or more parameters to the probability data for the one or more parameters for the two or more different golf clubs.

4. The method of claim 3, where the probability data is either a Gaussian probability distribution or a measured histogram probability distribution for the two or more different golf clubs.

5. The method of claim 2, wherein determining a most probable used golf club comprises:

providing the obtained one or more parameters as input to a previously constructed network of nodes with trained weights, which has been trained for the two or more different golf clubs using one or more obtained parameters from earlier golf ball flights.

6. The method of claim 2, wherein the ball spin probability data is defined as a mean spin value and a standard deviation of spin values for the most probable used golf club.

7. The method of claim 2, wherein the similarity between the portion of the observed trajectory and a corresponding portion of a simulated trajectory for a spin candidate is determined by:

simulating a trajectory of the golf ball having the spin of the spin candidate, wherein the simulation uses a physics model and one or more of the obtained parameters;

selecting a plurality of instances in time; and for each selected instance, determining a difference between the observed trajectory and the simulated trajectory, respectively, and combining the differences to obtain a similarity value to be used when adjusting the probability for the spin candidate.

8. The method of claim 7, wherein:

the difference is a difference in one or more of: acceleration, velocity, and/or position of the golf ball, and combining the differences includes one or more of: averaging the differences, summing the differences, and/or comparing the difference to find the smallest difference.

9. The method of claim 7, further comprising modifying the differences prior to combining the differences by adding a weight factor to each difference and/or raising one or more of the differences to a predetermined power.

10. The method of claim 1, wherein the method is performed at a golf practice range or golf course.

11. The method of claim 1, wherein the one or more sensors include a radar, a camera, or both.

12. A computer software program product arranged to, when executed, perform the method operations of claim 1.

13. A system for determining spin of a golf ball in flight comprising:

a data processing apparatus comprising a processor and a memory, the memory containing instructions that, when executed by the processor, causes the processor to:

obtain at least a portion of an observed trajectory of the golf ball and one or more parameters associated with the observed trajectory, wherein the one or more parameters include one or more of launch angle, ball speed, club speed, ball carry, or a combination thereof, the observed trajectory comprising three-dimensional locations of the golf ball over time, as determined from observations of the golf ball by one or more camera based tracking sensors;

obtain two or more spin candidates for the golf ball, each spin candidate having an associated measurement probability indicating relative frequency of different spin values;

determine a most probable used golf club for launching the golf ball into the observed trajectory, based on probability data for one or more parameters for two or more different golf clubs;

obtain ball spin probability data for the most probable used golf club;

determine the spin of the golf ball to be the spin candidate which is most probable, based on the ball spin probability data and the obtained portion of the observed trajectory, wherein the determining is based on a combination of measurement probability, club spin probability and physics probability, wherein the club spin probability indicates how likely the most probable used golf club generated the spin candidate, and the physics probability refers to probability converted from an error between the observed trajectory and a simulated trajectory; and display the determined spin of the golf ball on a display device.

* * * * *